United States Patent [19]

Wright, Thomas M.

[11] Patent Number: 4,644,691

[45] Date of Patent: Feb. 24, 1987

[54] APPARATUS FOR MOUNTING AND STABILIZING A TILTABLE WINDOW SASH

[75] Inventor: Wright, Thomas M., Rockford, Ill.

[73] Assignee: Amerock Corporation, Rockford, Ill.

[21] Appl. No.: 743,564

[22] Filed: Jun. 11, 1985

[51] Int. Cl.[4] ..... E05D 15/22

[52] U.S. Cl. ..... 49/161; 49/181; 403/61

[58] Field of Search ..... 49/161, 181; 403/4, 403/61, 80, 112

[56] References Cited

U.S. PATENT DOCUMENTS

| | | | |
|---|---|---|---|
| 781,971 | 2/1905 | Thomas | 403/61 |
| 2,699,346 | 1/1955 | Roethel | 403/61 |
| 3,399,490 | 9/1968 | Hettinger | 49/161 |
| 3,441,978 | 5/1969 | Perry | 16/197 |
| 4,144,674 | 3/1979 | Dovman | 49/181 |
| 4,364,199 | 12/1982 | Johnson et al. | 49/181 |

FOREIGN PATENT DOCUMENTS

| | | | |
|---|---|---|---|
| 670901 | 9/1963 | Canada | 49/181 |

*Primary Examiner*—Kenneth J. Dorner
*Assistant Examiner*—Gerald A. Anderson
*Attorney, Agent, or Firm*—Leydig, Voit & Mayer, Ltd.

[57] ABSTRACT

A window sash is mounted for downward and inward tilting by a pair of grooved spools which project laterally into channels formed in the side jambs of the window. The grooves in the spools track along vertical ribs formed in the channels and normally move freely along the ribs to permit free up and down movement of the sash. When the sash is tilted downwardly and inwardly, the side walls of the spool grooves frictionally pinch the ribs to restrict up and down movement of the sash and to help stabilize the tilted sash.

9 Claims, 11 Drawing Figures

APPARATUS FOR MOUNTING AND STABILIZING A TILTABLE WINDOW SASH

BACKGROUND OF THE INVENTION

This invention relates generally to apparatus for mounting a window sash for up and down movement in a window frame and also for downward and inward tilting relative to the frame. The sash may, for example, be tilted downwardly and inwardly into a building in order to facilitate washing the outer side of the window pane.

In certain windows, the tilted sash is held in a generally horizontal position by flexible cords which extend from the usual counterbalancers of the window. The cords alone, however, cannot keep the sash stable and cannot hold the sash at a fixed elevation when the sash is horizontal.

SUMMARY OF THE INVENTION

The general aim of the present invention is to provide new and comparatively simple apparatus which helps retain the tilted sash in a horizontal position, which may be manufactured relatively inexpensively and with good dimensional control, and which is mounted so as to inhibit removal of the sash by burglars.

A more detailed object of the invention is to achieve the foregoing through the provision of unique spool units which not only serve as a pivot mounting for the sash but which also frictionally grip the insides of the window side jambs and stabilize the sash when the latter is tilted downwardly and inwardly.

Another object of the invention is to provide a spool unit in which a novel grooved spool tracks extruded ribs on the inside of the jamb and allows free up and down movement of the sash as long as the sash is vertical. When the sash is tilted, the spool defines the pivot axis for the sash and, at the same time, pinches against the ribs to restrict up and down movement of the sash so as to help stabilize the sash.

The invention also resides in the unique manner of mounting the spool units to enable the spool units to shift laterally relative to the sash and continue to track the ribs when the sash is tilted.

A further object of the invention is to attach the spool units to the sash in such a manner as to discourage burglars from removing the spool units and prying out the sash.

These and other objects and advantages of the invention will become more apparent from the following detailed description when taken in conjunction with the accompanying drawings.

DETAILED DESCRIPTION OF THE PREFERRED EMBODIMENT

Figure 1:
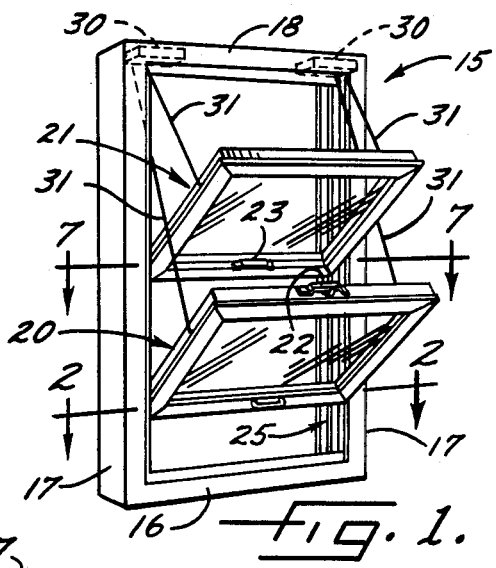
FIG. 1 is a perspective view of a window equipped with new and improved mounting apparatus incorporating the unique features of the present invention, the sashes of the window being shown tilted partially downwardly toward horizontal positions.

For purposes of illustration, the invention is shown in the drawings in apparatus for mounting one or more window sashes in a rectangular frame 15 having a lower sill 16, two upright side members 17 and a top member 18. In this particular instance, the window is double hung and includes a lower inside sash 20 and an upper outside sash 21 each having a rectangular frame movable upwardly and downwardly in the stationary frame 15. When the sashes are closed, the lower sash 20 rests on the sill 16 while the upper sash 21 abuts the top frame member 18. A latch 22 at the upper end of the lower sash 20 coacts with a strike 23 at the lower end of the upper sash 21 to releasably lock the sashes in their closed positions.

To support the sashes 20 and 21 for up and down movement, upright side jambs 25 (FIG. 2) made of plastic or other resiliently flexile material are secured to the upright side members 17 of the frame 15. The upright sides of each sash are formed with generally V-shaped grooves 26 which slidably receive complementary shaped ribs 27 on the side jambs to hold the sash in the frame 15 and to guide the sash for relatively friction-free up and down sliding. Spring clips 28 are fitted between the side jambs 25 and the side members 17 of the frame 15 to press the side jambs inwardly into contact with the upright sides of the sashes.

The sashes 20 and 21 are counterbalanced by counterbalancing devices 30 (FIG. 1) which are located within the upper frame member 18 and which may be of the same general type as disclosed in Anderson U.S. Pat. No. 3,335,455. Two cords 31 extend from each sash to the counterbalancers 30. The counterbalancers exert upward forces on the sashes through the cords to offset the weight of the sashes and retain the latter in selected vertical positions in the frame 15.

To facilitate washing the outsides of the window panes, the sashes 20 and 21 are adapted to be tilted downwardly and inwardly relative to the frame 15 to substantially horizontal positions inside the building (the sashes only being shown partially tilted in FIG. 1). When a downward and inward tilting force is exerted on each sash, the sides of the sash cam against the flexible side jambs 25 and press the jambs laterally outwardly against the spring action of the clips 28. The side jambs are pressed laterally outwardly from the positions shown in FIGS. 2 and 7 to the positions shown in FIGS. 3 and 9 to release the ribs 27 from the grooves 26 and free the sashes to tilt to a horizontal position. When each sash is tilted downwardly, the cords 31 are pulled out of the counterbalancers 30 and support the free end portion of the sash.

In accordance with the present invention, novel spools 35 (FIG. 2) are carried on the lower end portion of each sash 20 and 21 and are disposed within channels 36 formed in the side jambs 25. Normally, the spools ride freely along ribs 37 in the channels and permit free up and down movement of the sash. When the sash is tilted downwardly and inwardly, the spools define the pivot axis for the sash and, at the same time, lock frictionally against the ribs 37 to help stabilize the sash in its horizontal position.

More specifically, each spool 35 herein is in the form of a generally cylindrical member made of plastic such as Delrin and located adjacent the bottom of the sash 20, 21; there being one spool extending laterally outwardly from each upright side of each sash. Each spool is located with its axis extending perpendicular to the adjacent upright side of the sash and is fixed non-rotatably to the sash.

Each side jamb is formed with two vertically extending channels 36, one receiving the spool 35 of the lower sash 20 and the other receiving the spool of the upper sash 21 and spaced outwardly from the first channel. Each channel is generally U-shaped in cross-section and has one transverse dimension just slightly greater than the diameter of the spool. The other transverse dimension of the channel is somewhat greater than the length of the spool and thus the spool normally is spaced from the free edge portions of the ribs 27. The channels are integral with the plastic side jambs 25, the latter preferably being an extrusion. When each sash 20, 21 is tilted downwardly, the spools 35 turn in the channels 36 and serve as pivots for the sash.

In carrying out the invention, each spool 35 is formed with a radially opening and circumferentially extending groove 40 (see FIGS. 2, 10 and 11) which extends around the outer periphery of the spool and receives the ribs 37. Preferably, each channel 36 is formed with two vertically extending ribs 37 which project into the channel from the inner and outer sides thereof. The ribs extend along the entire length of the channel and are formed when the side jamb 25 is extruded.

When each sash 20, 21 is in its normal upright position, there is substantial axial clearance between the ribs 37 and the opposing side walls of the grooves 40 in the spool 35. Thus, the spools move upwardly and downwardly in the channels 36 without frictionally engaging the ribs 37 and without interfering with free up and down movement of the sash. When the sash is tilted downwardly, however, the side walls of the grooves 40 frictionally grip or pinch the ribs 37 so as to tend to hold the spools 35 in fixed vertical positions and to stabilize the sash. For these purposes, portions of each groove 40 are formed so as to be of different axial widths. Specifically, two diametrically spaced portions of each groove are sufficiently wide to receive the ribs 37 with substantial axial clearance. On two other diametrically spaced portions, a protrusion 43 (FIGS. 5 and 6) is formed on one side wall of the groove and significantly narrows the axial width of the groove. Each protrusion preferably is in the form of a pad molded integrally with the inboard side wall of the groove. Each circumferentially facing edge of each pad is sloped or inclined as indicated at 44 to facilitate initial movement of the pad into engagement with the rib with a slight camming action.

Figure 2:
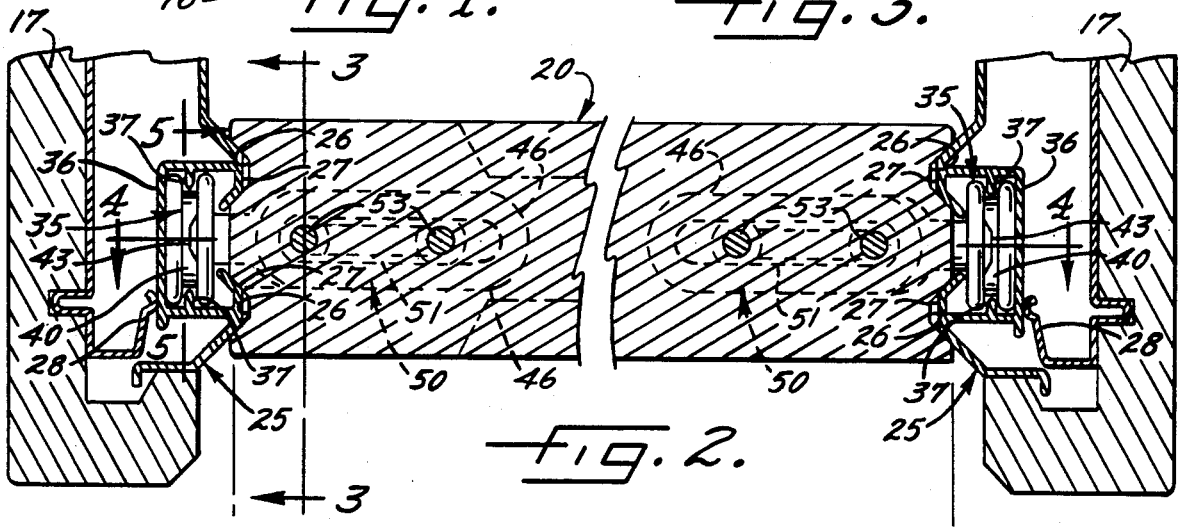
FIG. 2 is an enlarged fragmentary cross-section as would appear substantially along the line 2—2 of FIG. 1 when the lower sash of the window is in its normal vertical and closed position.
Figure 5:
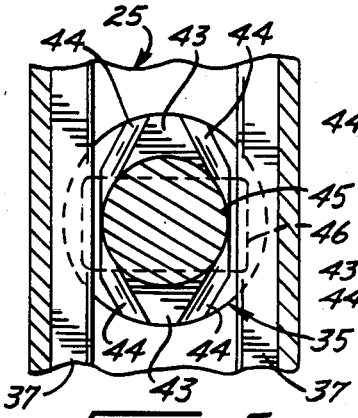
FIG. 5 is an enlarged fragmentary cross-section taken substantially along the line 5—5 of FIG. 2 and shows the lower sash in its normal vertical position.
Figure 6:
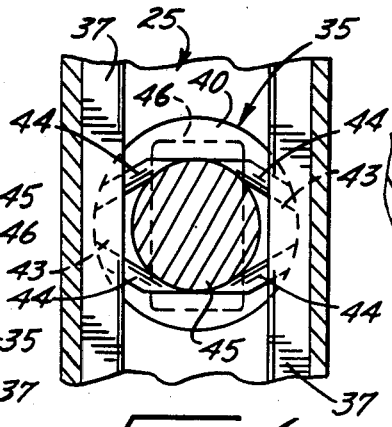
FIG. 6 is an enlarged fragmentary cross-section taken substantially along the line 6—6 of FIG. 4 and shows the lower sash in its horizontal position.
Figure 7:
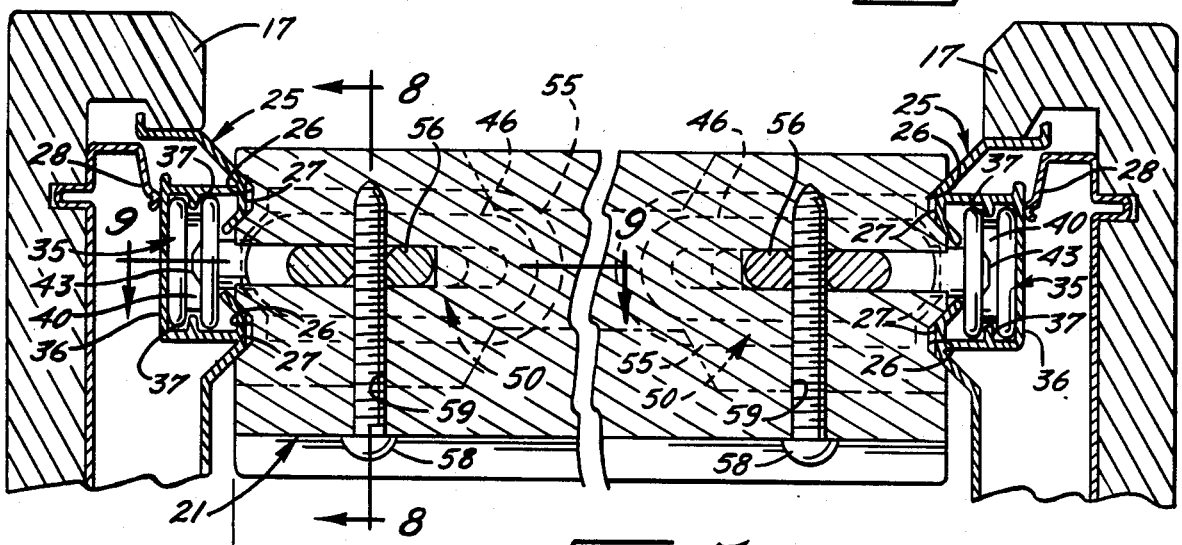
FIG. 7 is an enlarged fragmentary cross-section as would appear substantially along the line 7—7 of FIG. 1 when the upper sash of the window is in its normal vertical and closed position.

With the foregoing arrangement, the pads 43 extend vertically and are positioned circumferentially so as to be free and clear of the ribs 37 when the sash 20, 21 is in a vertical position (see FIGS. 2, 5 and 7). Thus, the pads do not engage the ribs and obstruct normal up and down movement of the sash.

Figure 4:
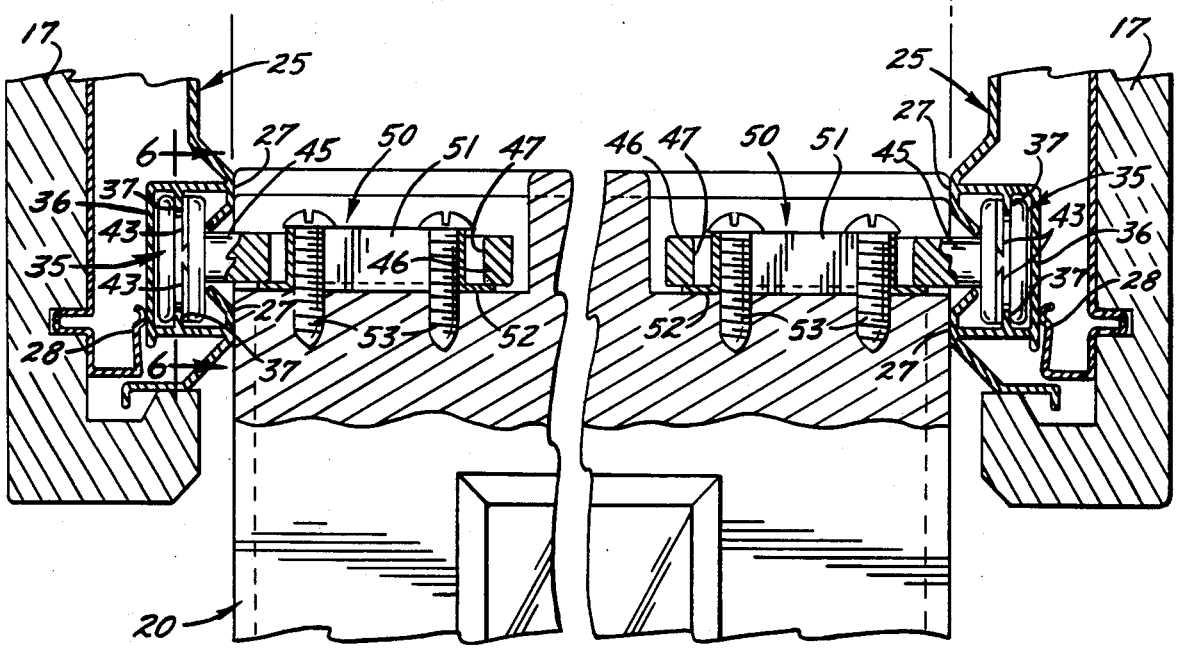
FIG. 4 is a view similar to FIG. 2 but shows the lower sash tilted downwardly and inwardly to a horizontal position.

When the sash 20, 21 is initially tilted downwardly and the spools 35 turn, the pads 43 rotate into engagement with the ribs 37 as permitted by the sloped edges 44 of the pads. With continued tilting of the sash, the pads 43 move into full face-to-face engagement with the ribs 37 (see FIGS. 4, 6 and 9) and cause the ribs to be gripped or pinched between the pads and the opposing side wall of the groove. Such pinching creates a frictional force which tends to lock the sash in a fixed vertical position and to restrict free pivoting of the sash. The spools 35 thus coact with the cords 31 to hold the sash in a substantially vertically fixed horizontal position and to keep the sash from bouncing upwardly and downwardly. This is achieved in a simple manner by the ribs 37 and the pads 43 and, since the ribs are uniformly extruded, very close good dimensional control between the ribs and the pads may be maintained.

Figure 10:
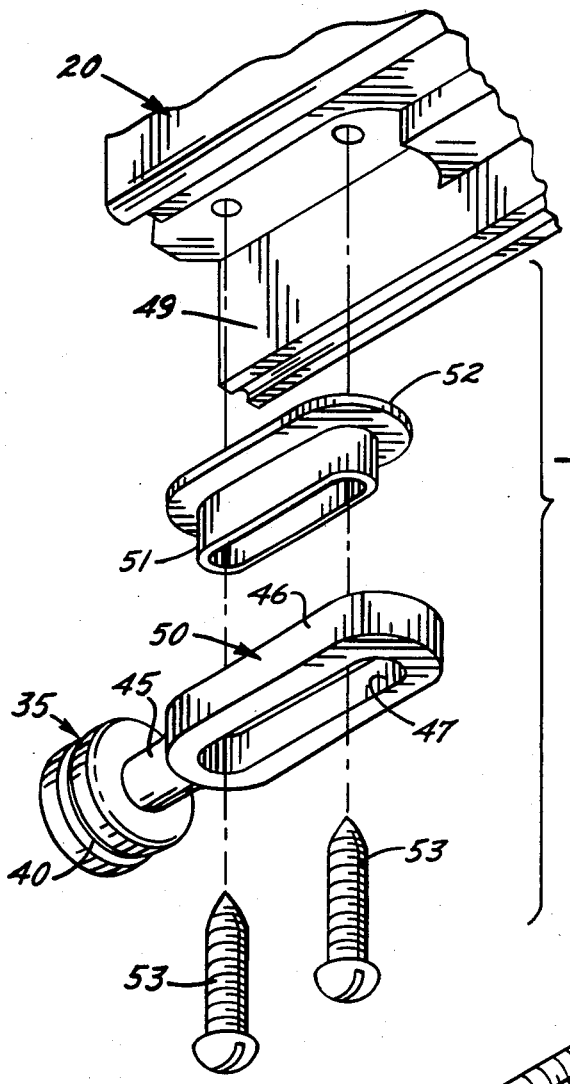
FIG. 10 is an exploded perspective view of part of the apparatus for pivotally mounting the lower sash.
Figure 11:
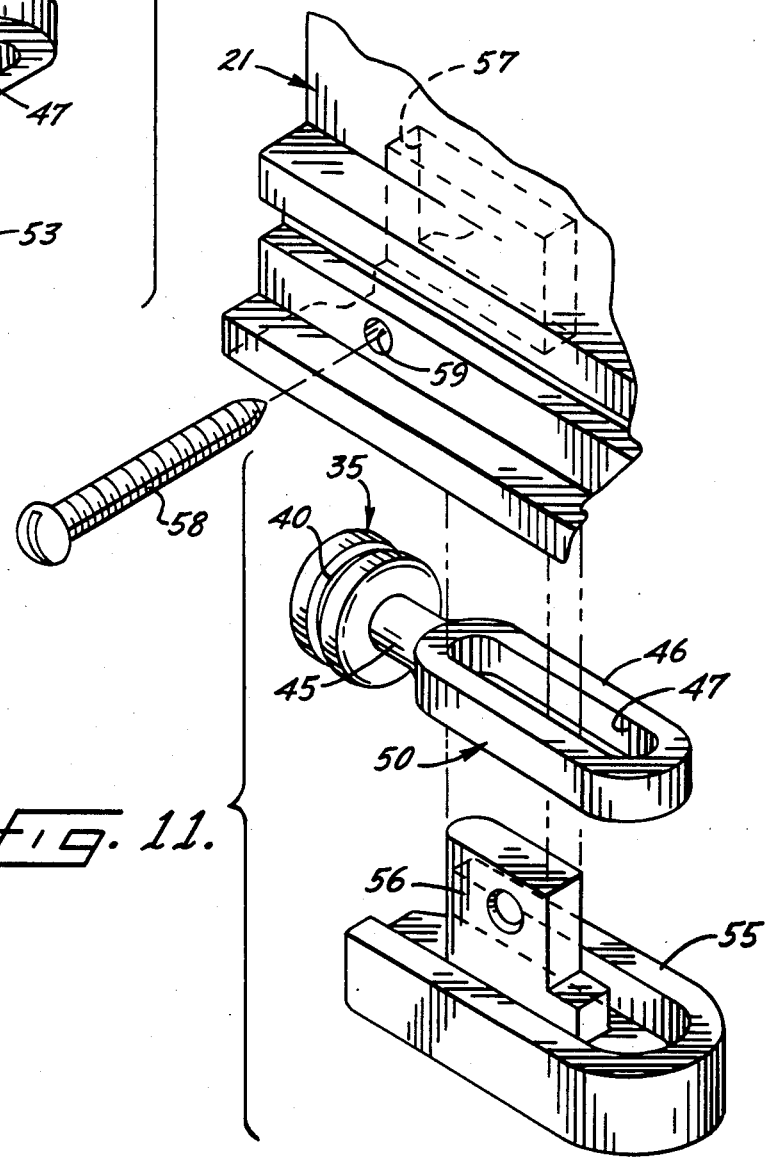
FIG. 11 is an exploded perspective view of part of the apparatus for pivotally mounting the upper sash.

When each sash 20, 21 is tilted, the spools 35 shift axially relative to the sash to enable the sash to press the flexible jambs 25 laterally outwardly while keeping the grooves 40 of the spools alined with the ribs 37. To these ends, each spool is rigid with a cylindrical rod-like shank member 45 (FIGS. 10 and 11) which, in turn, is rigid with an elongated plate member 46 formed with a racetrack-shaped opening 47. The spool 35, the shank 45 and the plate 46 preferably are formed as a one-piece molded unit 50 (FIGS. 10 and 11).

In the case of the lower sash 20, each unit 50 is located adjacent the bottom of the sash and is shielded from the outside by a vertically extending outer strip 49 (FIGS. 3 and 10) of the sash. To mount each lower unit 50 so that the sash 20 may shift laterally relative to the spool 35, provision is made of a tubular racetrack-shaped tongue or bushing 51 (FIG. 10) integral with the lower side of a flange 52 and adapted to fit into the opening 47 in the plate 46. The height of the bushing 52 is slightly greater than the height of the opening 47, the width of the bushing is about equal to the width of the opening and the length of the bushing is somewhat less than the length of the opening. Two screws 53 extend through the opening 47 and the bushing 51 and are threaded into the bottom of the sash 20. The heads of the screws clamp against the lower side of the bushing and overlap the plate 46 without clamping against the plate (see FIGS. 3 and 4). Thus, the screws captivate the plate 46 vertically with respect to the bushing 51 but do not restrict longitudinal sliding of the plate relative to the bushing.

With the foregoing arrangement, the spools 35 of the lower sash 20 are free to shift laterally relative to the sash. Thus, when the lower sash presses the side jambs 25 laterally outwardly and cams past the side jambs, the spools are free to shift with the side jambs and relative to the sash from the position shown in FIG. 2 to the position shown in FIG. 4. Accordingly, the grooves 40 in the spools remain in tracking engagement with the ribs 37.

Figure 3:
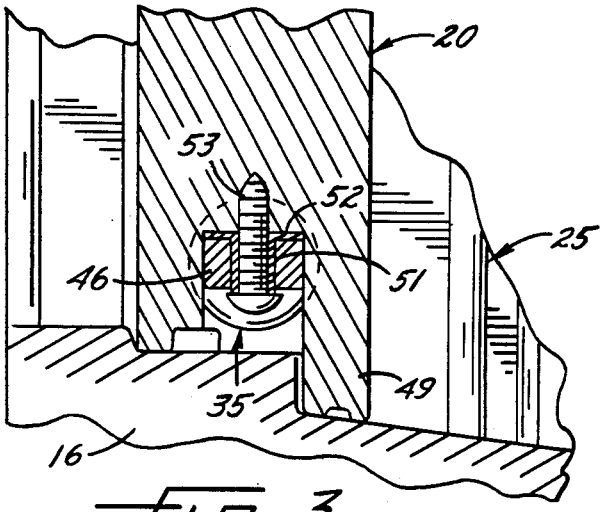
FIG. 3 is a fragmentary cross-section taken substantially along the line 3—3 of FIG. 2.

When the lower sash 20 is fully closed, the spool units 50 thereof are fully shielded by the sill 16 and the front sash strip 49 (see FIG. 3). Thus, it is not possible for a burglar to gain access to the screws 53 and remove the spool units 50 to facilitate inward prying of the lower sash.

Figure 8:
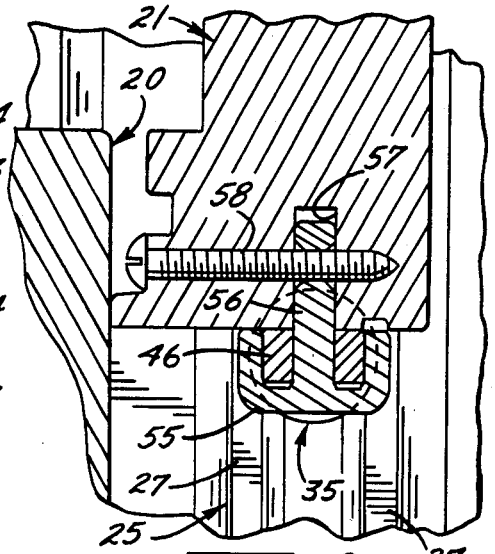
FIG. 8 is a fragmentary cross-section taken substantially along the line 8—8 of FIG. 7.
Figure 9:
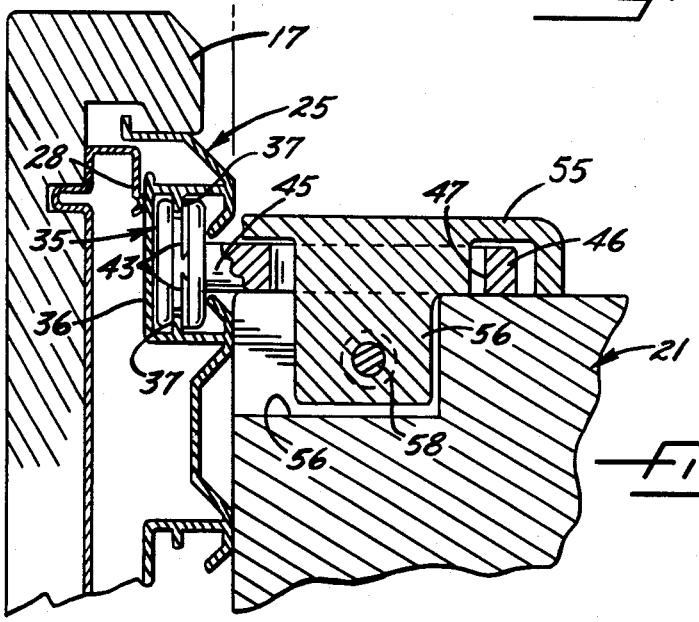
FIG. 9 is a fragmentary view similar to FIG. 7 but shows the upper sash tilted downwardly and inwardly to a horizontal position.

A somewhat different arrangement is used to mount the spool units 50 of the upper outside sash 21. To effect such mounting, provision is made of a dish-shaped cover member 55 (FIG. 11) sized to receive each plate 46. Formed integrally with the cover is a tongue 56 which projects upwardly through the opening 47 in the plate 46 of the spool unit 50 and also upwardly into a downwardly opening notch 57 (FIGS. 8, 9 and 11) formed in the bottom of the upper sash between the inner and outer sides thereof. A screw 58 is inserted into a hole 59 in the inner side of the bottom of the upper sash, extends through the hole in the tongue and is threaded into the upper sash as shown in FIGS. 8 and 9. The screw secures the cover 55 and the spool unit 50 to the bottom of the upper sash and is inaccessible from the outer side of the upper sash. As before, the plate 46 of the spool unit 50 is capable of shifting along the tongue 56 when the upper sash is tilted and the jamb 25 is pressed outwardly.

I claim:

1. Apparatus for supporting an upright window sash for up and down movement and mounting the sash for downward and inward tilting, said apparatus comprising a pair of vertically fixed upright side jambs located on opposite upright sides of the sash, means on opposite upright sides of the sash and coacting with said side jambs to guide said sash for up and down movement relative to said side jambs, an upright, mounting means extending laterally from the adjacent upright side of the sash near the lower end thereof to mount said sash for downward and inward tilting, said mounting means comprising a spool disposed within said channel and fixed against rotation relative to said sash, a radially outwardly opening groove extending circumferentially around said spool between the ends thereof and located completely within said channel, an upright rib projecting into said channel between opposite laterally spaced upright sides thereof and extending into said groove, one circumferentially extending portion of said groove being of one axial width and moving freely along said rib during normal upward and downward movement of said sash, and another circumferentially extending portion of said groove being of a narrower axial width and pinching against said rib when said spool is turned in said channel during downward and inward tilting of said sash whereby said pinching frictionally resists free vertical movement of the sash when the latter is in a tilted position.

2. Window mounting apparatus as defined in claim 1 in which two substantially diametrically spaced circumferentially extending portions of said groove are of said one axial width, and two additional substantially diametrically spaced circumferentially extending portions of said groove being of said narrower axial width.

3. Window mounting apparatus as defined in claim 2 in which each of said additional diametrically spaced portions of said groove is defined by an axially projecting protrusion on the side wall of the groove, at least one circumferentially facing side of each protrusion defining an inclined cam surface.

4. Window mounting apparatus as defined in claim 3 in which each protrusion includes a second circumferentially facing side which faces opposite of said one side and which also defines an inclined cam surface.

5. Window mounting apparatus as defined in claim 1 further including means securing said spool non-rotatably to said sash, said securing means comprising a member extending axially from said spool and formed with an axially elongated opening.

6. Window mounting apparatus as defined in claim 5 in which said securing means further includes a member having a tongue fitted slidably into said elongated opening to permit said spool to move axially relative to said sash.

7. Window mounting apparatus as defined in claim 6 in which said tongue has a vertical dimension greater than the vertical dimension of said opening.

8. Window mounting apparatus as defined in claim 6 further including a cover on the lower end of said tongue and enclosing said axially extending member.

9. Apparatus for supporting an upright window sash for up and down movement in a frame and mounting the sash for downward and inward tilting relative to the frame, said apparatus comprising a pair of upright side jambs made of resiliently yieldable material and attached to said frame, means on opposite upright sides of said sash and coacting with said side jambs to guide said sash for up and down movement relative to said side jambs, an upright channel formed in each of said side jambs, mounting means extending laterally from the upright sides of said sash adjacent the lower end thereof and projecting into said channels to mount said sashfor downward and inward tilting, each of said mounting means comprising a generally cylindrical spool disposed within said channel and fixed against rotation relative to said sash, the axis of said spool extending perpendicular to the adjacent upright side of the sash, a circumferentially extending and radially outwardly opening groove formed around the periphery of said spool between the ends thereof and located completely with said channel, upright ribs projecting into said channel from the inner and outer sides thereof and between opposite laterally spaced sides thereof and extending into said groove, the opposing side walls of said groove being spaced from and moving freely along said ribs during normal upward and downward movement of said sash, and means on a portion of one of said side walls and pinching said ribs against the other of said side walls when said spool is turned in said channel during downward and inward tilting of said sash whereby such pinching frictionally restricts free vertical movement of the sash when the latter is in a tilted position.

* * * * *